US006094557A

United States Patent [19]

Shinohara

[11] Patent Number: 6,094,557

[45] Date of Patent: Jul. 25, 2000

[54] IMAGE FORMING APPARATUS

[75] Inventor: Hayato Shinohara, Yokohama, Japan

[73] Assignee: Canon Kabushiki Kaisha, Tokyo, Japan

[21] Appl. No.: 09/329,358

[22] Filed: Jun. 10, 1999

[30] Foreign Application Priority Data

Jun. 12, 1998 [JP] Japan ..... 10-165698
May 12, 1999 [JP] Japan ..... 11-131192

[51] Int. Cl.[7] ..... G03G 15/01

[52] U.S. Cl. ..... 399/302; 399/46; 399/298; 399/301

[58] Field of Search ..... 399/38, 46, 66, 399/107, 110, 111, 121, 297, 298, 302, 308, 313, 301, 318

[56] References Cited

U.S. PATENT DOCUMENTS 4,515,460 5/1985 Knechtel ..... 399/302
5,099,286 3/1992 Nishise et al. ..... 399/302
5,291,252 3/1994 Kawaishi ..... 399/301
5,565,975 10/1996 Kumon et al. ..... 399/302
5,587,769 12/1996 Sawada et al. ..... 399/110 X
5,732,314 3/1998 Tsukida et al. ..... 399/302
5,752,130 5/1998 Tanaka et al. ..... 399/308 X
5,802,442 9/1998 Konno et al. ..... 399/308
5,940,668 8/1999 Tanigawa et al. ..... 399/302
5,983,062 11/1999 Sameshima ..... 399/302

*Primary Examiner*—Sandra Brase
*Attorney, Agent, or Firm*—Fitzpatrick, Cella, Harper & Scinto

[57] ABSTRACT

An image forming apparatus has a photosensitive drum on which toner images of different colors are formed and sequentially transferred in layers to an intermediate transfer drum. In the continuous color image formation, depending on whether to be the first page or after second page, for example, the control of the correcting system for color mis-registration is switched so that the mechanical effect on the apparatus caused by biasing and unbiasing actions of a transfer roller and an ICL roller toward the intermediate transfer drum in each condition can be suppressed to the minimum without penalties in throughput.

33 Claims, 12 Drawing Sheets

IMAGE FORMING APPARATUS

BACKGROUND OF THE INVENTION

1. Field of the Invention

The present invention relates to an electrophotographic image forming apparatus such as a copying machine, a printer, and a facsimile machine.

2. Description of the Related Art

Hitherto, in an electrophotographic color image forming apparatus in which a toner image is formed on a photosensitive drum (an image bearing member) to be sequentially transferred in layers to an intermediate transfer drum and the image on the transfer drum in turn is further transferred to a transfer material such as a sheet of paper by a transfer member such as a transfer roller and a transfer belt capable of engaging and separating from the intermediate transfer drum, when color printing is continuously controlled, the pressure balance of an entire image forming mechanism is changed by a transfer action of the transfer member on a transfer material. This results in a positional deviation of the transfer member and an image-deteriorating problem such as color mis-registration and banding owing to vibration generated during the abutting and separating of the transfer member, which affects the next image. Referring to FIGS. 2 and 3, the contents will be further described. As for each of the members and mechanisms in FIGS. 2 and 3, the details will be described in the item of the preferred embodiments referring to FIG. 1. FIG. 2 is a schematic view illustrating the abutting state of the transfer roller in intentional exaggeration. Referring to FIG. 2, when the transfer roller 10 moves toward the intermediate transfer drum 9 (in the direction of the arrow) and abuts the intermediate transfer drum 9, a force is applied to the intermediate transfer drum 9 in the direction of the arrow. Simultaneously, a force in the direction of the arrow is also applied to the photosensitive drum 15 abutting the other side of the intermediate transfer drum 9, such that the position of a laser beam applied to the photosensitive drum 15 from a scanner unit 30, that is the position "P" at which a latent image is formed, will become slightly mis-aligned. Therefore, the latent image forming position "P" and a primary transfer position "Q" changes slightly according to whether the transfer roller 10 is abutting the intermediate transfer rollers or not, so that the distance between the latent image forming position changes and the transfer position along the peripheral surface.

The effect on the next image will be described in timing progress by referring to FIG. 3. The signals shown in FIG. 3 will be described in detail by referring FIG. 5. AS will be understood from FIG. 3, while the transfer roller is driven, that is, at "on" timings of the T2R" signal, which is the driving signal of the transfer roller, the next "Y" latent image is adversely affected during forming of this image.

Therefore, during forming of continuous images, the toner image (the latent image) formed when the second color is mis-registered relative to the toner image (the latent image) of the first color when the second page is formed on the photosensitive drum, resulting in producing color mis-registration. This phenomenon occurs in a like manner when an "ICL" roller 39, which charges the residual toner on the intermediate transfer drum with electricity, abuts on and is separated from the intermediate transfer drum.

Conventionally, as will be described by referring to FIG. 5, a rotation without image forming of the photosensitive drum 15, that is idle rotation, is interposed every time during the driving of the transfer roller while forming continuous images in order to minimize color mis-registration and banding by avoiding adverse effects of the transfer roller 10. This is a passive countermeasure that avoids the impact of the mechanical structure and waits for convergence of the vibration rather than a positive measure that eliminates the effect.

In the above-described conventional examples, during forming of continuous images, there has been the problem of color mis-registration or reduced throughput due to every time interposition of the above-described idle rotation.

SUMMARY OF THE INVENTION

It is an object of the present invention to provide an image forming apparatus in which color mis-registration resulting from misalignment of the toner images formed in layers on the intermediate transfer drum can be prevented.

Further objects of the present invention will become apparent from the following detailed description.

DESCRIPTION OF THE PREFERRED EMBODIMENTS

Figure 1:
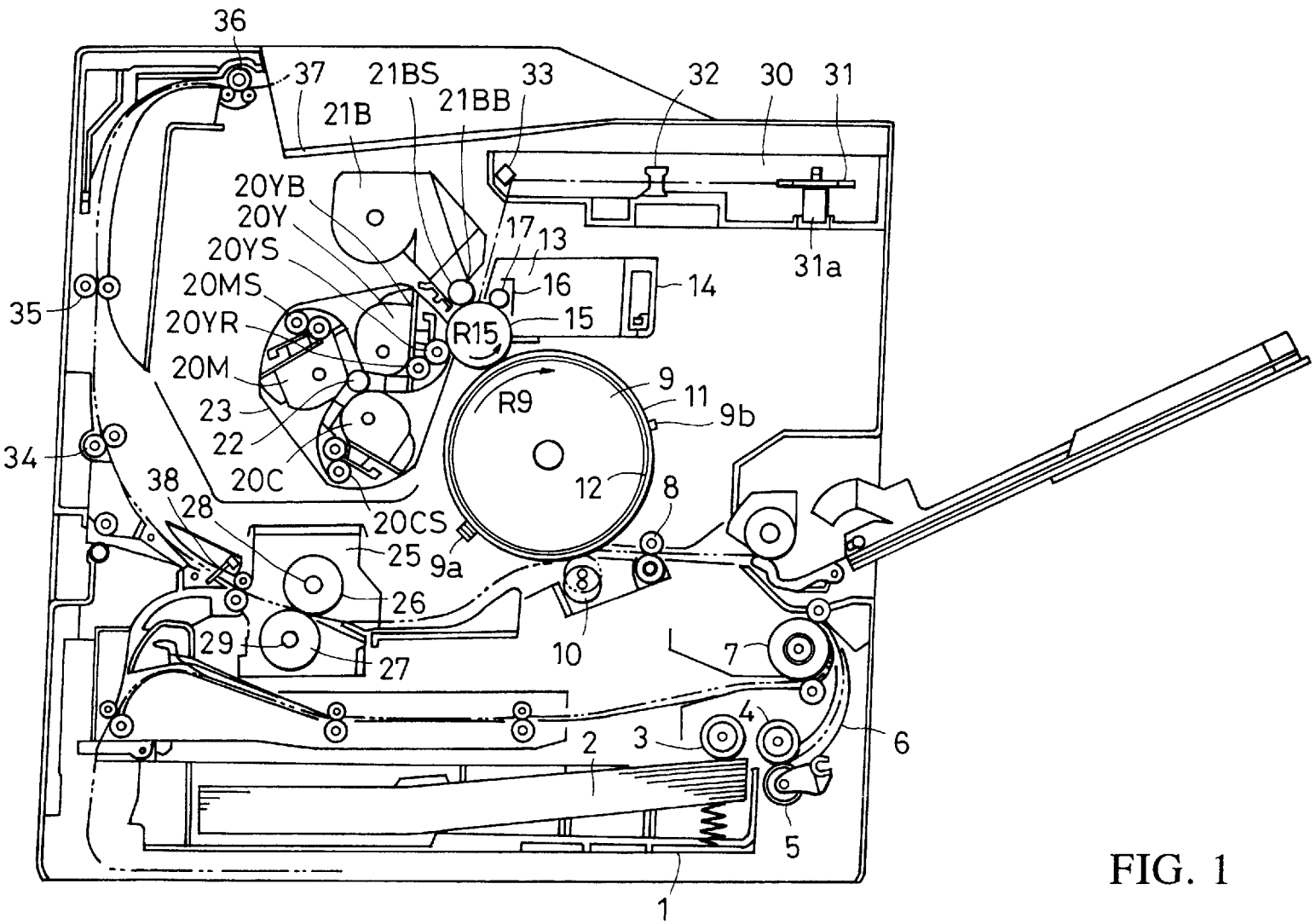
FIG. 1 is a cross-sectional view showing a schematic structure of an image forming apparatus according to the present invention.

Referring to the drawings, embodiments of the present invention will now be described below.

First Embodiment

The entire structure of an image forming apparatus according to the present invention will be generally described with reference to FIG. 1. FIG. 1 is a schematic representation of the entire structure of a color laser printer, which is an example of the image forming apparatus.

In the image forming apparatus shown in FIG. 1, a color image is developed in an image forming section mounted thereon comprising a fixed black developer unit 21B and three rotatable color developer units 20Y, 20M, and 20C, so as to be transferred in layers to an intermediate transfer member, and the color image in turn is further transferred to a transfer material 2 supplied from a supply section to form a color image transferred thereon. The transfer material 2 is conveyed to a fusing section so that the color image disposed thereon is fused on the transfer material 2 to be ejected to a discharge section 37 disposed on the top surface of the apparatus by discharge rollers 36.

The above-mentioned rotatable color developer units 20Y, 20M, and 20C and the fixed black developer unit 21B are independently detachably formed in the image forming apparatus body.

Exposure to light for the image forming section is performed by a scanner section 30 as exposing means (image forming means). When an image signal is supplied to a laser diode, the laser diode irradiates a polygonal mirror 31 with an image ray corresponding to the image signal. The polygonal mirror 31 is rotated at a high speed by a scanner motor 31*a* formed such that the surface of a photosensitive drum (an image bearer) 15 rotating at a constant speed is selectively exposed to the image ray reflected by the polygonal mirror 31 through an image formation lens 32 and a reflecting mirror 33.

The structure of the image forming section will now be successively described in detail.

Image Bearer Member Unit

A drum unit 13 is formed by combining in unison of a drum type electrophotographic photosensitive body (referred to as a "photosensitive drum" below) 15, as an image bearing member and a container 14 of a cleaning device, which is in combination used as a holder for the photosensitive drum 15. The drum unit 13 is detachably supported in the image forming apparatus body, such that the photosensitive drum 15 is easily replaceable as a unit in accordance with its life span. The photosensitive drum 15 according to the present embodiment is formed of an aluminum cylinder having a diameter of "t" with an outer surface coated by an organic photoconductive layer thereon, is rotatably supported by the container 14 of the cleaning device, which is used in combination as the holder for the photosensitive drum 15. On the periphery of the photosensitive drum 15, a cleaner blade 16 and primary electric charging means 17 are disposed. The photosensitive drum 15 is rotated in the direction of an arrow R15 in accordance with image forming steps by transmitting the driving power to one end thereof in the rear of the drawing from a driving motor (not shown).

Electrical Charging Means

The primary electric charging means 17 functions as image forming means and is intended to uniformly charge the surface of the photosensitive drum 15 with electricity using a contact charging method in which a conductive roller is biased on the photosensitive drum 15 and a voltage is applied to the roller to charge the drum.

Cleaning Means

The cleaning means is intended to clean the residual toner left on the photosensitive drum 15 after the toner visualized by developing means is transferred to the intermediate transfer member 9. The waste toner collected by the cleaner blade 16 is stored to the cleaning container 14. The capacity of the cleaning container 14 is large enough for storing waste toner for a period longer than the life span of the photosensitive drum 15. Therefore, the cleaning container 14 is simultaneously replaceable unison with the life span replacement of the photosensitive drum 15.

Developing Means

The developing means, as image forming means, is formed of three rotary developer units 20Y, 20M, and 20C and one black developer unit 21B, which are developable colors of yellow, magenta, cyan, and black, respectively, so as to visualize the above-mentioned latent image.

The black developer unit 21B is a fixed developer unit, in which a sleeve 21BS is disposed at a position opposing the photosensitive drum 15 with a small clearance the sleeve 21BS and the photosensitive drum 15 so as to form a visualized image on the photosensitive drum 15 by black toner.

In the black developer unit 21B, toner in a container is fed by a feeding mechanism so as to be coated in a thin layer on the outer periphery of the sleeve 21BS rotating in the clockwise direction viewing FIG. 1 by a coating blade 21BB urged to contact the outer periphery of the sleeve 21BS, and thereby electric charge is applied to the toner (triboelectric charge). By applying developing bias to the sleeve 21BS, toner developing is achieved on the photosensitive drum 15 in accordance with the latent image.

Three rotary developer units 20Y, 20M, and 20C are independently detachably held to a developing rotary member 23 rotating about an axis 22. When an image is formed, each developing unit is rotated about the axis 22 in the state held by the developing rotary member 23 and the predetermined developing unit is stopped at a position opposed to the photosensitive drum 15. Further, after the developing sleeve is positioned to oppose the photosensitive drum 15 with a small clearance between, a visualized image is formed on the photosensitive drum 15. When the color image is formed, every one revolution of the intermediate transfer member 9, the developing rotary member 23 is rotated so that a developing process is performed by each developing unit in the following order yellow developer unit 20Y, magenta developer unit 20M, cyan developer unit 20C, and black developer unit 21B. While the intermediate transfer member 9 is rotated by four revolutions, a visual image is sequentially formed thereon by each of four toners having the colors of yellow, magenta, cyan, and black, respectively, so that a full-color image is formed on the intermediate transfer member 9.

FIG. 1 illustrates a state in which the yellow developer unit 20Y is positioned and stopped at the position opposing the drum unit 13. In the yellow developer unit 20Y, toner in a container is fed by a feeding mechanism to a coating roller 20YR so as to be coated in a thin layer on the outer periphery of a developing sleeve 20YS rotating in the clockwise direction, as viewing in FIG. 1, by the coating roller 20YR rotating in the clockwise direction, as viewed in FIG. 1, and a coating blade 20YB is urged in contact with the outer periphery of the developing sleeve 20YS, thereby applying electric charge to the toner (triboelectric charge). By applying developing bias to the sleeve 20YS opposed to the photosensitive drum 15 with the latent image formed thereon, toner developing is achieved on the photosensitive drum 15 in accordance with the latent image.

As for the magenta developer unit 20M and the cyan developer unit 20C, toner developing is achieved by the same mechanism as described above.

When each developer unit is rotated to its developing position, each sleeve of each of developer units 20Y, 20M, and 20C is connected to a driver of a high-voltage power source for developing each color disposed in the image forming apparatus body, so that a voltage is sequentially selectively applied to each sleeve for every developing operation of each color to drive the unit.

Intermediate Transfer Member

The intermediate transfer member 9 is rotated in the direction of an arrow R9 in order to receive four times multiple transfers from the photosensitive drum 15, when the color image is formed. The intermediate transfer member 9 with multiple transfers received thereon nips the transfer material 2 with a transfer roller (a transfer member) 10 with a voltage applied thereon to convey it, so that the toner image of each color on the intermediate transfer member 9 is transferred together to the transfer material 2.

The intermediate transfer member 9 according to the present embodiment is formed of an aluminum cylinder 12 with a diameter of 180 mm covered over the outer periphery thereof by an elastic layer 11, such as a sponge layer having a medium electrical resistance or a rubber layer having a medium electrical resistance. The intermediate transfer member 9 is rotatably supported and rotated by driving gears (not shown) fixed in one piece.

The intermediate transfer member 9 is formed such that both ends of the axis of rotation thereof are held by a holding member. The intermediate transfer member 9 along with the holding member is formed as an intermediate transfer unit, which is detachable from the apparatus body (for the replacement). The intermediate transfer unit is urged by a spring, e.g., being an elastic member, under the predetermined pressure when mounted so as to form a primary transfer section between the photosensitive drum 15 and the intermediate transfer member 9.

On the outer peripheral surface of the intermediate transfer member 9, a flag 9*b* for forming a reference signal of a vertically synchronous signal and an optical sensor 9*a* for detecting the signal.

Paper Feed Section

The paper feed section for supplying the transfer material 2 to the image forming section comprises mainly a cassette 1 with plural pieces of the transfer material 2 stored therein, a paper feed roller 3, a feed roller 4, a retard roller 5 for preventing overlapped feed, a paper feed guide 6, a conveying roller 7, and register rollers 8. When the image is formed, the paper feed roller 3 is rotated in accordance with image forming steps to feed a transfer material 2 stored in the cassette 1 one sheet at a time, which in turn is guided by the paper feed guide 6 to be conveyed to the register rollers 8 via the conveying roller 7. During the image forming steps, the register rollers 8 perform a non-rotational step for stopping and keeping the transfer material 2 waiting and a rotational step for conveying the transfer material 2 toward the intermediate transfer member 9 in a predetermined sequence, so that registration between the image and the transfer material 2 is performed in the transferring step as the next step.

Transfer Section

The transfer section comprises a swingable transfer roller 10.

The transfer roller 10 functions as urging means (transfer means), having a metal cylinder covered by foam elastic material with a medium electrical resistance, and is capable of vertical moving (abutting and separating) viewing FIG. 1 relative to the intermediate transfer member 9. During forming of the image of four colors on the intermediate transfer member 9, that is, during plural rotations of the intermediate transfer member 9, the transfer roller 10 is generally positioned at the lower position, indicated by a said line, in FIG. 1, and is separated from the intermediate transfer member 9 so as not to disturb the image. After formation of the toner image of four colors on the intermediate transfer member 9, the transfer roller 10 is urged to the intermediate transfer member 9 with the transfer material 2 pinched therebetween by a cam member (not shown) under a predetermined pressure at the position indicated by a phantom (broken) line in FIG. 1 in accordance with transfer timing of the color image to the transfer material 2. Simultaneously, a bias is applied to the transfer roller 10 so that the toner image on the intermediate transfer member 9 is transferred to the transfer material 2. Because the intermediate transfer member 9 and the transfer roller 10 are rotated respectively, upon transferring of the image, the transfer material 2 sandwiched by the two members above is conveyed to the left side, as viewed in FIG. 1, at a predetermined speed toward a fusing section 25 as the next process.

Fusing Section

The fusing section 25 for fusing the toner image formed by developer means and transferred on the transfer material 2 via the intermediate transfer member 9, comprises a fusing roller 26 for heating the transfer material 2 and a pressure roller 27 for urging the transfer material 2 to the fusing roller 26, as shown in FIG. 1. The rollers 26 and 27 are hollow-rollers having heaters 28 and 29 in the respective inside thereof and are rotated so as to simultaneously convey the transfer material 2. That is, the transfer material 2 with the toner image held thereon is conveyed by the fusing roller 26 and the pressure roller 27 and heat and pressure are simultaneously applied thereto, so that the toner image is fused on the surface of the transfer material 2.

Image Forming Steps

The image forming steps by the image forming apparatus formed as above will now be described. Referring to FIG. 1, one sheet of the transfer material 2 stored in the cassette 1 is separated to convey it to the register rollers 8 by rotating the paper feed roller 3.

Meanwhile, the photosensitive drum 15 and the intermediate transfer member 9 are rotated in the directions of the arrows, as viewed in FIG. 1. While the surface of the photosensitive drum 15 is uniformly electrically charged by the electric charging means 17, it is irradiated with yellow image light by the scanner section 30 to form a yellow latent image on the photosensitive drum 15. Along with the forming of the latent image, yellow developing is performed by driving the yellow developer 20Y, wherein a voltage having the same polarity and approximately the same potential to the charging polarity of the photosensitive drum 15 is applied such that yellow toner is deposited on the latent image on the photosensitive drum 15. A voltage of polarity opposite to that of the above-mentioned toner is applied to the intermediate transfer member 9 from an electric power source so as to primarily transfer the yellow toner on the photosensitive drum 15 to the surface of the intermediate transfer member 9.

After finishing of the primary transfer of the yellow toner to the intermediate transfer member 9, as described above, the magenta developer unit 20M is rotated so as to be positioned at the position opposing the photosensitive drum 15 by rotation of the developer rotary member 23, so that magenta toner is developed in a manner similar to that of the yellow toner. Then the latent image forming, developing thereof, and multiple transfers of toner to the intermediate transfer member 9 for the colors of cyan and black are sequentially performed to form a color image incorporating four colors of toner (yellow, magenta, cyan, and black) on the surface of the intermediate transfer member 9.

After formation of the color image on the surface of the intermediate transfer member 9, the transfer material 2 being kept waiting at the register rollers 8 is conveyed and urged to the intermediate transfer member 9 by the transfer roller 10. Simultaneously, the color image is transferred to the transfer material 2 by applying a reverse bias of that (reverse to the toner) to the transfer roller 10. After the transfer of the toner image to the transfer material 2 from the intermediate transfer member 9, the transfer roller 10 is separated from the intermediate transfer member 9. In addition, while the toner image is transferred by pinching the transfer material 2 between the transfer roller 10 and the intermediate transfer member 9 to convey it, Y image of the next image (the second page) is started to be formed on the photosensitive drum 15. After completion of formation of the Y image on the surface of the photosensitive drum 15, the transfer roller 10 is moved from the urging position, in which the transfer material 2 is pinched between the intermediate transfer member 9 and the transfer roller 10, to the remote position, prior to the starting of the next M image formation. The transfer material 2 is separated from the intermediate transfer member 9 so as to convey it to the fusing section 25. After fusing the toner, the transfer material 2 is discharged to the discharge section 37 disposed on the top of the body via pairs of discharge rollers 34, 35, and 36, with the image side surface facing down so as to accomplish the image forming steps.

After the transfer of the toner image to the transfer material 2 from the intermediate transfer member 9, a charging roller 39 (abbreviated as an ICL roller below) functions as urging means (charging member), which charges the residual toner left on the intermediate transfer member 9 in the reverse polarity of the normal polarity of the toner, is urged by the intermediate transfer member 9. After charging the residual toner, the ICL roller 39 is separated from the intermediate transfer member 9. In addition, when a continuous image is formed, during abutting of the ICL roller 39 on the intermediate transfer member 9, a Y image as the next image is formed on the photosensitive drum 15, and then, the ICL roller 39 is separated from the intermediate transfer member 9 when the Y image transferred onto the intermediate transfer member 9 passes through the abutting position by the ICL roller 39.

The residual toner charged by the ICL roller 39 is electrostatically transferred in reverse to the photosensitive drum 15 at the primary transfer position to be recovered to the cleaning container 14 by the cleaner blade 16. Parallel processing of the reverse transfer of the residual toner and the transfer of the Y image, as the next image from the photosensitive drum 15 to the intermediate transfer member 9 with the application of the primary electric field, enables the image formation to improve the throughput thereof.

Figure 5:
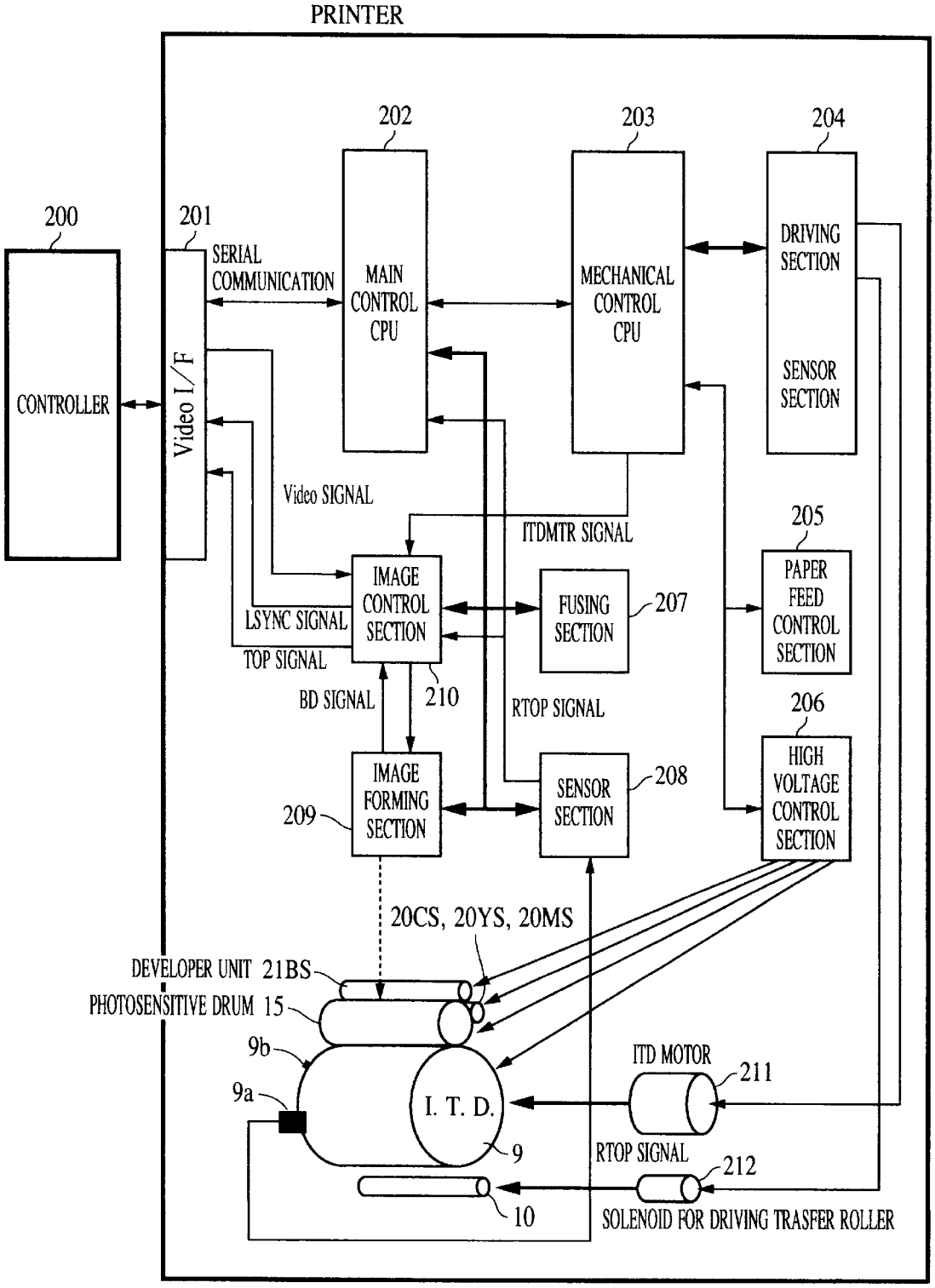
FIG. 5 is a system block diagram of the image forming apparatus according to the present invention.

FIG. 5 is a schematic system block diagram of the image forming apparatus. A controller 200, as an external controller, controls the image forming apparatus and an interface section 201 connects between the controller 200 and the color image forming apparatus. The interface section 201 comprises a serial communication section in which the controller 200 issues a command to the image forming apparatus which returns a status to the controller 200, and an image forming signal section including image data. A main control CPU 202 functions as modulating means and respectively controls a fusing section 207 (25 in FIG. 1), a sensor section 208, such as the optical sensor 9*a* for detecting the flag 9*b* of the intermediate transfer member (ITD) 9, an image control section 210 for performing control related to image formation, such as executing image processing PWM control, etc., to the image data received from the interface section 201, producing a TPO signal as a vertical synchronous signal from a RTOP signal output from the optical sensor 9*a*, and producing a LSYNC signal as a horizontal synchronous signal from an image forming section 209, which is specifically a BD synchronous signal output by the scanner unit 30, the image forming section 209 for image-output control of a laser output, a scanner motor, etc., and a mechanical control CPU 203 as a sub CPU. The controller 200 sends a Video signal as an image signal to the image forming apparatus synchronized with the TPO signal as a vertical synchronous signal and the LSYNC signal as a horizontal synchronous signal. The mechanical control CPU 203 respectively controls a driving section for a motor, a clutch, etc., specifically for example, an ITD motor 211 for driving the intermediate transfer member (ITD) 9, a solenoid 212 for driving and controlling an abutting and separating movement of the transfer roller 10, the sensor section 204, a paper feed control section 205, and a high voltage control section. FIG. 5 shows an outline that the high voltage control section 206 respectively controls developing bias for the developer unit 21BS, charging bias for the photosensitive drum 15, and primary transfer bias for the intermediate transfer member 9. An ITDMTR signal shown in FIG. 5 is an output signal synchronized with a driving signal of the ITD motor 211.

Figure 6:
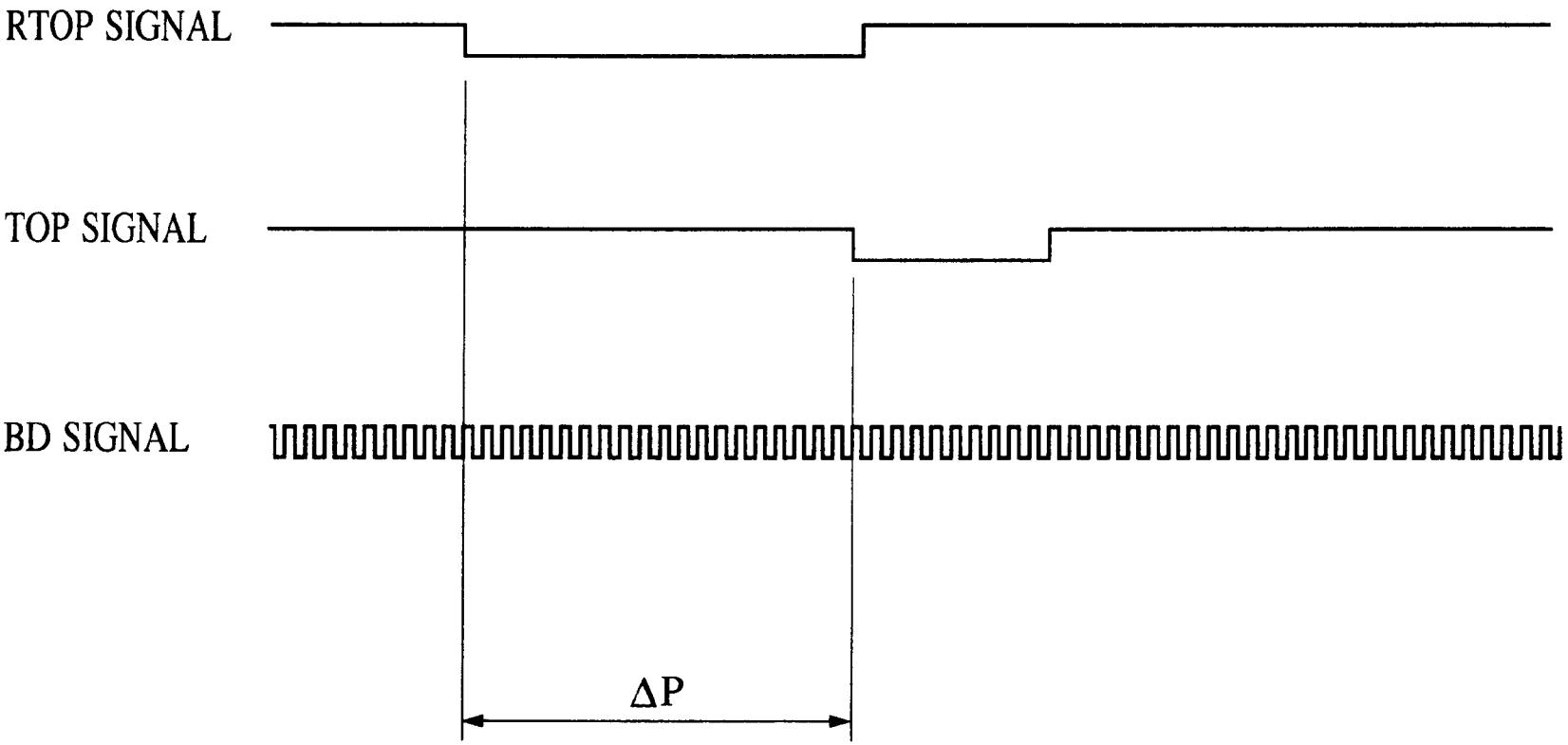
FIG. 6 is a schematic representation showing correcting control of color mis-registration.

FIG. 6 is a schematic representation showing correcting means of color mis-registration. A RTOP signal output from the optical sensor 9*a* for detecting the flag 9*b* disposed on the peripheral surface (one end portion in the axial direction) of the intermediate transfer member 9 is an absolute signal indicating an image forming position on the intermediate transfer member 9. A TOP signal is controlled to output after the image control section 210 (specifically a gate array) counts ΔP signals of the BD signal starting from the reclining point of the RTOP signal. That is, it is possible to shift the writing position by ΔP×BD signals from the absolute position on the intermediate transfer member 9. The value of "ΔP" is controllable to be changed; it is controllable by the main control CPU 202 by writing the desired value in the inside register of the image control section 210.

Figure 7:
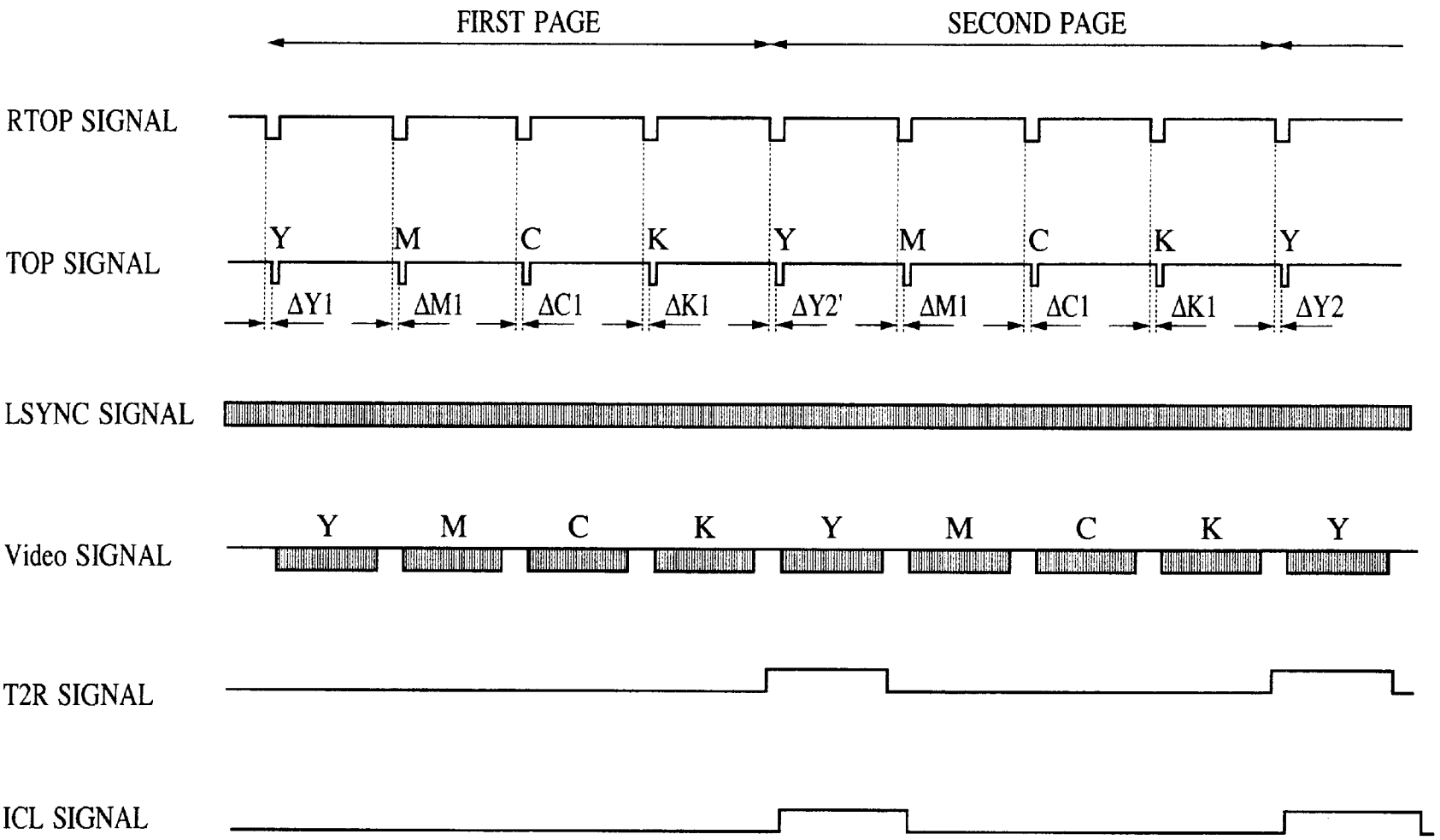
FIG. 7 is a schematic representation showing reduction of the effect of the transfer system by means of the correcting control of the color mis-registration.

FIG. 7 is a timing chart showing the outline of the switching and implementation of the correcting control of the color mis-registration in the first page and after the second page of the full color continuous printing. FIG. 7 shows that when the Y image of the first page is formed, the correcting value of the mis-registration is "ΔY1" because the transfer roller 10 and the ICL roller 39 are not biased, while the correcting control of the color mis-registration is implemented by the correcting value of the mis-registration "ΔY2" after the second page because the transfer roller 10 and the ICL roller 39 are biased. The size of the transfer material 2 used at this time is "Δ4", and the maximum toner image length possible to transfer on this size is smaller than the length between the exposure position and the secondary transfer position via the primary transfer position along the peripheral length of the photosensitive drum 15 and the intermediate transfer member 9.

The above-described correcting control is defined to correct the timing of forming the latent image on the photosensitive drum, that is, to correct the writing position of the latent image in the rotation axial direction and/or direction orthogonal to a rotational direction of the photosensitive drum. When the peripheral velocity of the photosensitive drum varies slighty, the length of the latent image (an expansion and contraction rate) may be corrected along with the above-mentioned correction.

Figure 8:
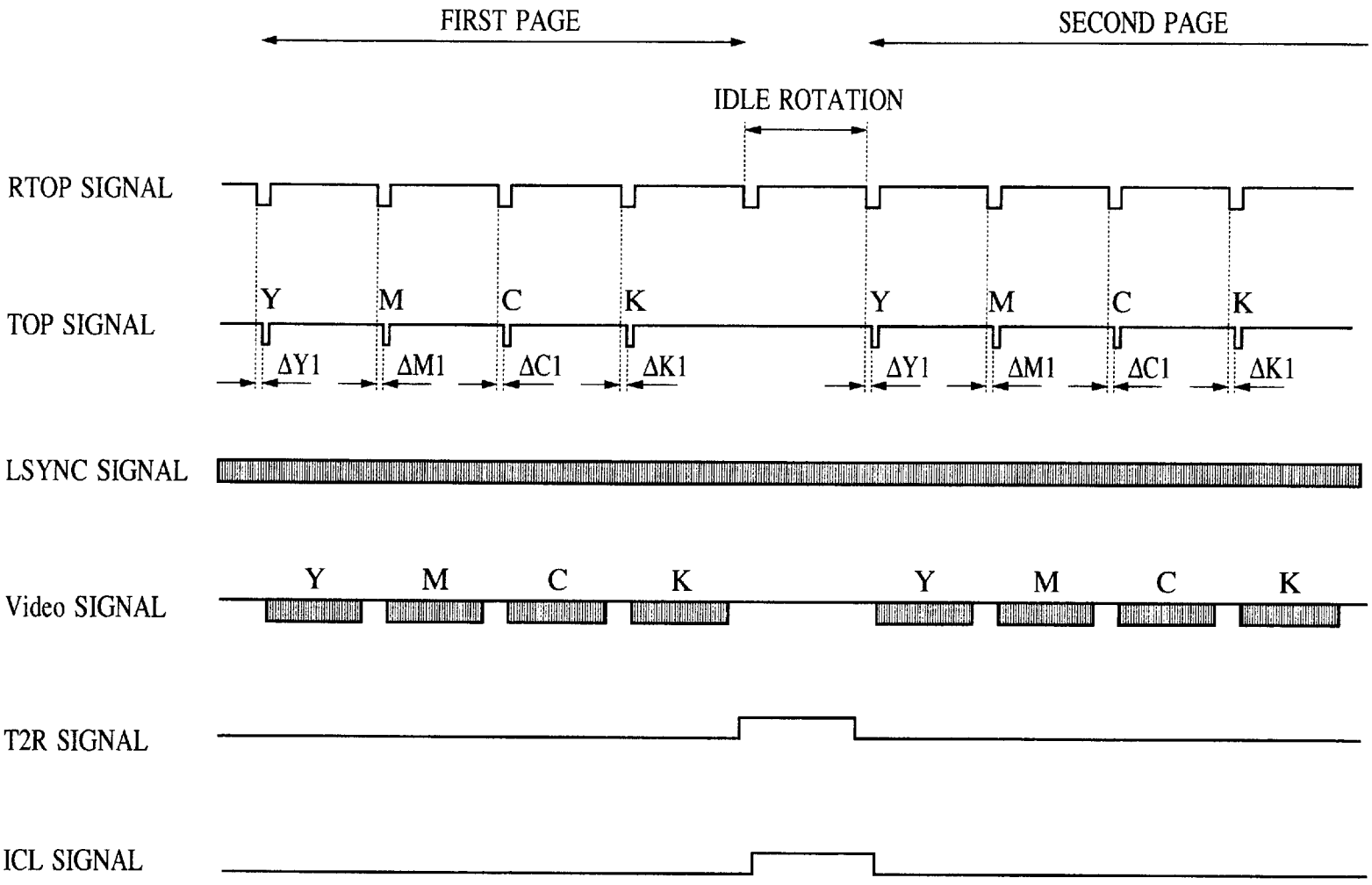
FIG. 8 is a schematic representation showing reduction of the effect of the transfer system by means of the correcting control of the color mis-registration during interposing of idle rotation.

FIG. 8 is a timing chart showing the outline of the correcting control of the color mis-registration during interposing of idle rotation. The image forming apparatus at the command of interposing of idle rotation through the serial communication from the controller 200 executes the interposing of idle rotation mode. Referring to FIG. 7, after the second page, because the transfer roller 10 and the ICL roller 39 are biased when the Y image is formed, the correcting control of the color mis-registration is implemented by the correcting value "ΔY2" of the mis-registration, allowing for the variance shift in the latent image forming position by the effect of the abutting of the transfer roller 10 and the ICL roller 39. In contrast, referring back to FIG. 8, because of interposing of idle rotation while the transfer roller 10 and the ICL roller 39 are biased, the correcting control of the color mis-registration is implemented by the correcting value "ΔY1" of the mis-registration also after the second page, free from the abutting.

Figure 9:
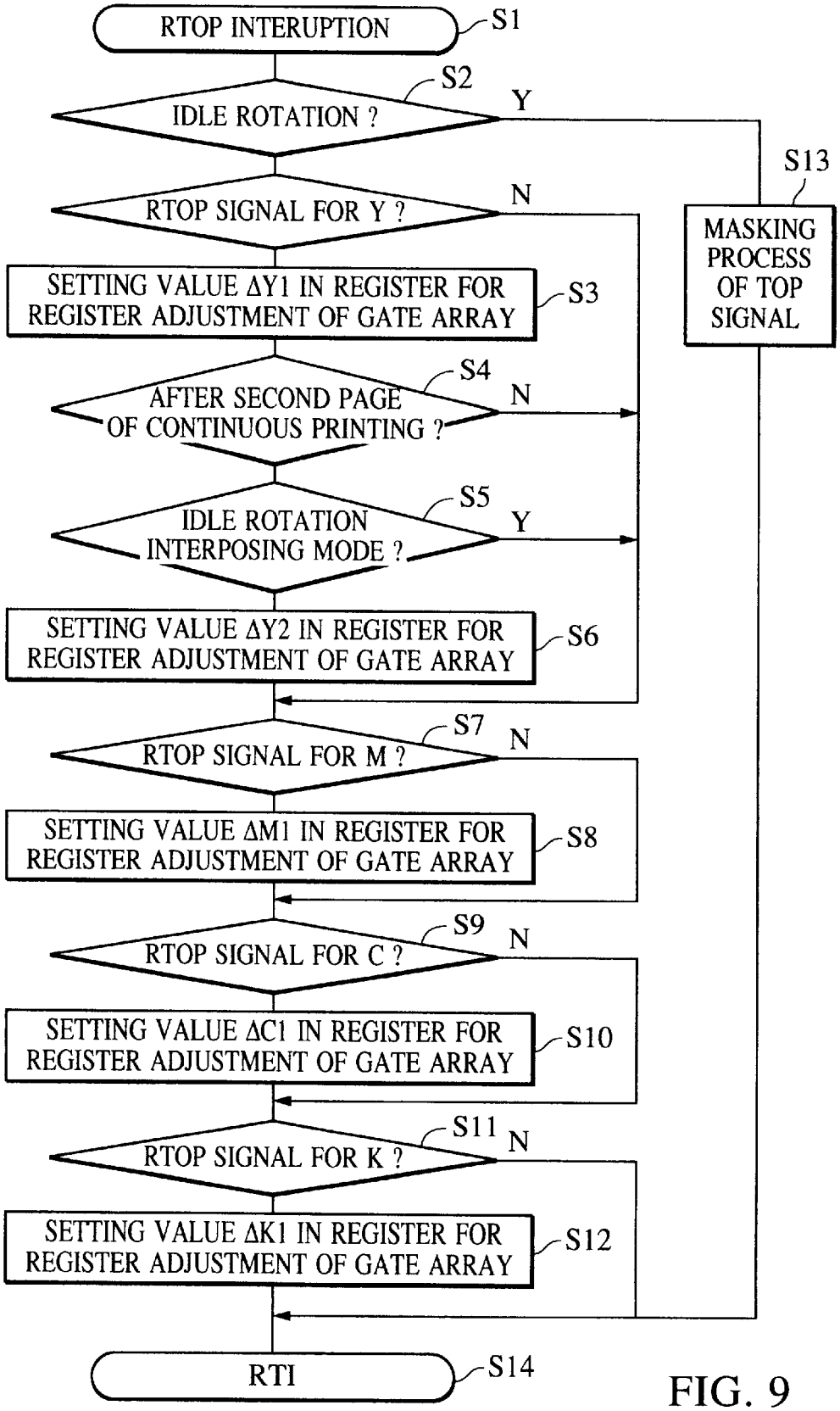
FIG. 9 is a flow chart for achieving the reduction of the effect of the transfer system shown in FIGS. 7 and 8.

FIG. 9 is a flow chart of the interrupt processing program executed by the main control CPU 202 by inputting the RTOP signal for achieving the correcting control of the color mis-registration as shown in FIGS. 7 and 8. The RTOP interrupt processing is started at SI. At S2, it is determined whether this interrupt processing is for the idle rotation. If "Yes", the masking processing of the TOP signal is executed at S13 to demand the controller 200 to stop the output of the image data. If "No", the following correcting processing of the color mis-registration for each color is executed. At S3, it is determined whether it is an RTOP signal for "Y". If "Yes", at S3, the value "ΔY1" is written in the register for the register adjustment the, i.e., the register for adjusting writing position of the image control section 210, that is, the gate array. Then, at S4, this RTOP signal for "Y" is determined whether to be after the second page of the continuous printing or not. If "No", that is the first page, the value "ΔY1" is not changed, while if "Yes", then at S5, it is determined whether to be commanded the interposing of idle rotation by the controller 200 or not. If "Yes", the correcting value "ΔY1" is left as it is, because it is free from the effect of the transfer roller 10. If "No", however, because of the effect of the transfer roller 10, the correcting value of color mis-registration is changed to "ΔY2" at S6. At S7, it is determined whether it is an RTOP signal for "M". If "Yes", at S8, the value "ΔM1" is written in the register for register adjustment, i.e., the register for adjusting the writing position of the image control section 210, that is, the gate array. At S9, it is determined whether it is an RTOP signal for "C". If "Yes", at S10, the value "ΔC1" is written in the register for register adjustment the, i.e., the register for adjusting writing position of the image control section 210, that is, the gate array. At S11, it is determined whether it is an RTOP signal for "K". If "Yes", at S12, the value "ΔK1" is written in the register for register adjustment, i.e., the register for adjusting the writing position of the image control section 210, that is, the gate array. At S14, interrupt processing by the RTOP signal is completed.

The description of the other processing such as shunting process of the register or the stack is omitted because they are not essential for the present invention.

As described above, in the continuous color image forming of at least two colors, corresponding to the image forming condition such as the condition whether it is the first page or after second page, the control of correcting means of color mis-registration is switched so that the effect in each condition can be suppressed to the minimum, even when the transfer roller and ICL roller abut the intermediate transfer member, because the control of correcting means of color mis-registration is switched between a mode for the first page being free from the effect of the abutting and another mode for after the second page being affected by the abutting. This results in achieving the most suitable correction of color mis-registration.

For the user demanding the further advanced correction of color mis-registration, a high image quality mode that selectively interposes idle rotation is provided. In this mode, although throughput is reduced, color mis-registration and banding can be extremely minimized to achieve high image quality even when the control of correcting means of color mis-registration is not switched because of being free from the effect of the urging of the transfer roller and ICL roller in both conditions of being the first page and after second page in the continuous color image forming.

Figure 10:
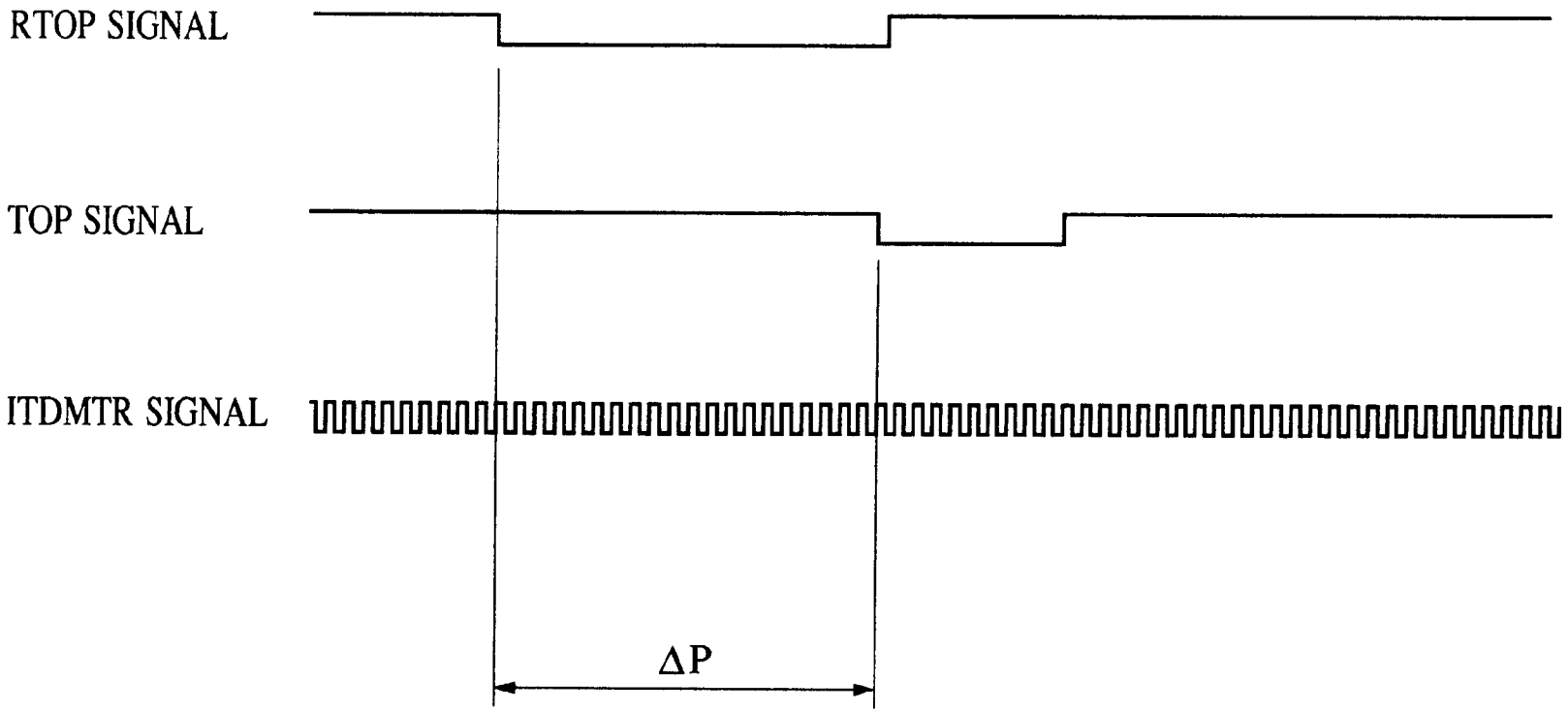
FIG. 10 is a timing chart for describing another embodiment.

Second Embodiment FIG. 10 shows a second embodiment. In accordance with the above-described first embodiment, as described in reference to FIG. 6, the correcting means of color mis-registration is achieved by shifting the writing position by ΔP×BD signals from the absolute position on the intermediate transfer member 9, outputting a TOP signal by counting ΔP signals of the BD signal from the reclining point of the RTOP signal. Further, the value of "ΔP" is controllable to be changed, that is, it is to be controllable for the main control CPU 202 by writing the desired value in the inside register of the image control section 210. In this embodiment, the feature thereof is that the counting object of ΔP is not the BD signal but is a ITDMTR signal which is output synchronized with a driving signal of an ITD motor.

Figure 11:
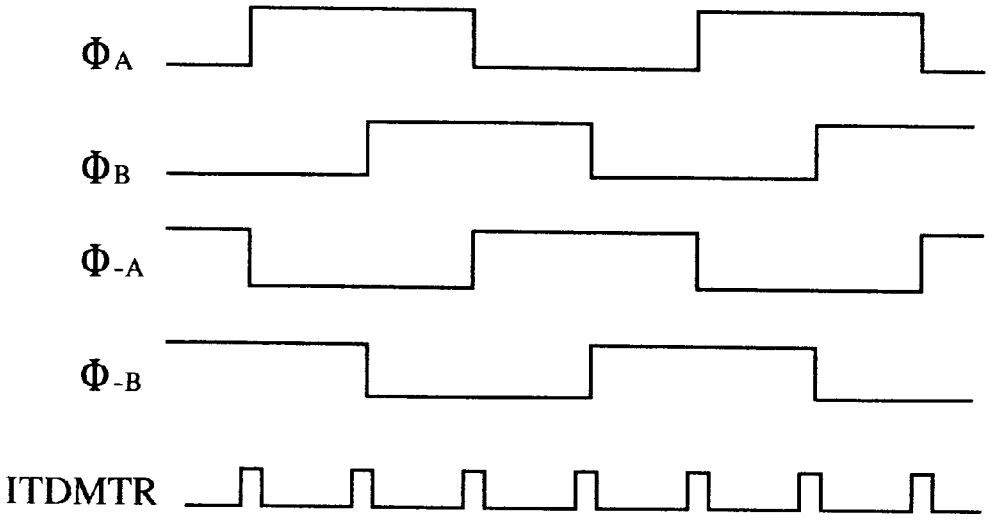
FIG. 11 is a schematic representation showing an example of driving signal waveforms of an ITD motor.

FIG. 11 shows an example of driving signal waveforms of the ITD motor shown in FIG. 5. FIG. 11 shows the two-phase excitation driving. As understood by FIG. 11, the ITDMTR signal is output synchronized with each phase (two steps) and an advancing timing.

Figure 12:
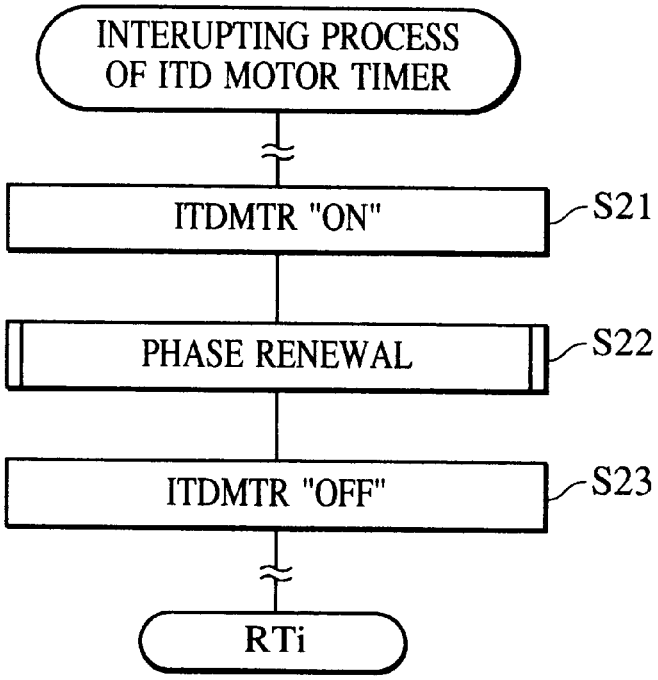
FIG. 12 is a schematic representation showing the interrupt process of an ITD motor timer executed by a mechanical controlling CPU for outputting a signal shown in FIG. 11.

The flow chart shown in FIG. 12 is for describing the interrupt process of an ITD motor timer executed by the mechanical controlling CPU 203 for outputting a signal shown in FIG. 11. In the interrupt process, the ITDMTR signal is "ON"(S21), and at S22, renewal processing of output pattern of phases $\phi_A - \phi_{-B}$ is executed and at S 23, the ITDMTR signal is "OFF".

As described above, the BD signal, the signal for driving the ITD motor, or the signal formed by a clock signal entered in the image control section may be possible to use as the signal related to the horizontal synchronization. After all, the signals being countable the register periodically may be applicable in several ways.

Figure 13:
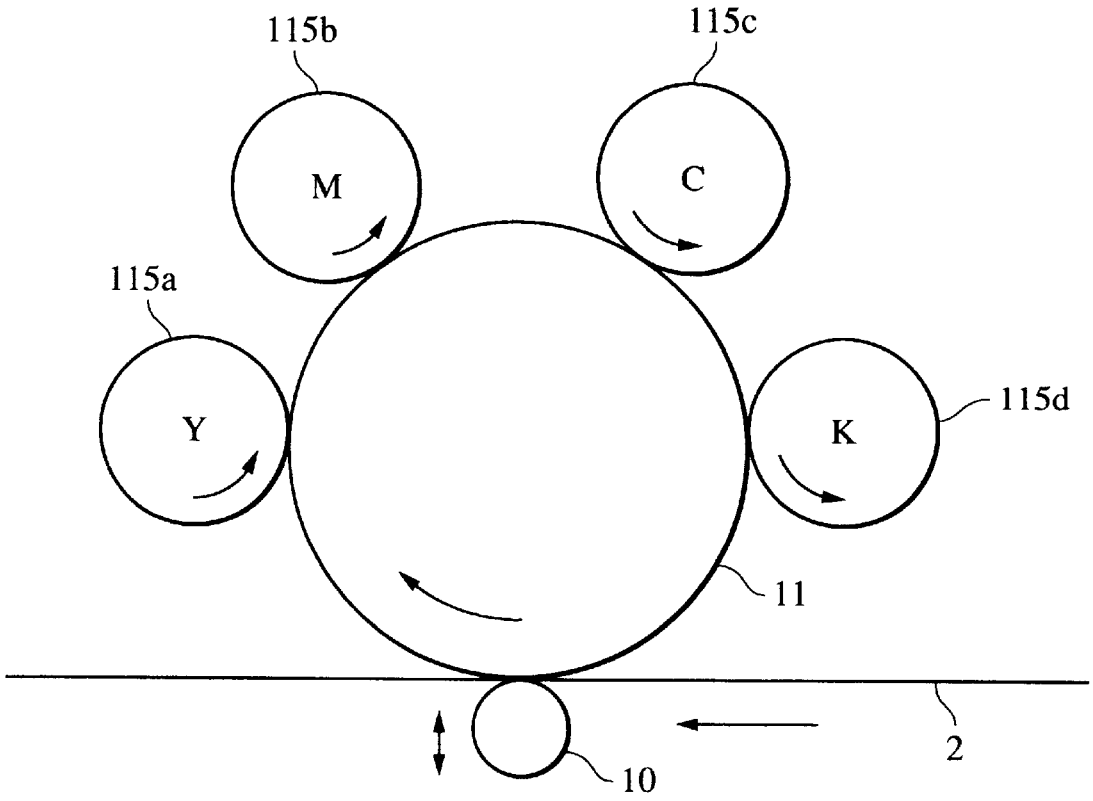
FIG. 13 is a cross-sectional view showing a diagrammatic structure of the image forming apparatus according to the present invention.

In the above-described first and second embodiments, the description has been made of an image forming apparatus of the type having one photosensitive drum on which the toner image is formed to be sequentially transferred in layers to the intermediate transfer drum. The present invention is not limited to this type but may be applicable to an image a forming apparatus of the type having a plurality of photosensitive drums (four drums, for example), as shown in FIG. 13, from which each of four toner images is sequentially transferred to the intermediate transfer drum. In this type of image forming apparatus, the invention is applicable when the same transfer roller as that in the first and second embodiment is also formed so as to be capable of engaging and separating from the intermediate transfer drum. In this case, when images are continuously formed on a plurality of transfer materials, the timing of forming a toner image (a latent image) on the predetermined photosensitive drum in the photosensitive drums 115*a* to 115*d* is also adjusted in accordance with teeding of the transfer material, which is whether the first page or after the second page so that color mis-registration can be prevented. There is a following case, for example. In the case that the transfer roller is located in the abutting position while a Y image and an M image are formed on the photosensitive drums 115*a* and 115*b*, respectively, the above-described correcting control for color mis-registration is performed to prevent color mis-registration when a C image and a K image are formed on the photosensitive drums 115*c* and 115*d*, respectively, so that the C image and the K image (black) are precisely overlapped relative to the Y image and the M image on the intermediate transfer drum.

While the above-described embodiments have been described with respect to color mis-registration is common to the use of a transfer roller 10 and ICL roller 39, it is to be understood that the invention is not limited to these embodiments and the invention is intended to cover various modifications. While the drum type intermediate transfer member is described, a belt type body may be applied to the present invention.

What is claimed is:

1. An image forming apparatus comprising:

rotatable image bearing means;

image forming means for forming a toner image on said rotatable image bearing means;

a rotatable intermediate transfer member contactable with said rotatable image bearing means, toner images of a plurality of colors on said rotatable image bearing means being sequentially transferred in layers to said rotatable intermediate transfer member to form a multi-color toner image on said intermediate transfer member, the multi-color toner image on said rotatable intermediate transfer member being transferable to a transfer material;

urging means for urging said rotatable intermediate transfer member against said rotatable image bearing means, said urging means being locatable in a contact position, in which said urging means contacts said rotatable intermediate transfer members, and in a non-contact position, in which said urging means is separated from said rotatable intermediate transfer member; and control means for controlling a start timing for image formation on said rotatable image bearing means by said image forming means, wherein when said image forming means starts to form a toner image on said rotatable image bearing means, said control means varies the start timing of image formation by said image forming means based on whether said urging means is located in the contact position or in the non-contact position.

2. An apparatus according to claim 1, wherein said urging means is located in the contact position while said image forming means forms toner images of a predetermined number of colors among the plurality of colors on said rotatable image bearing means.

3. An apparatus according to claim 2, wherein said urging means moves to the non-contact position after said image forming means completes formation of toner images of the predetermined number of colors on said rotatable image bearing means and prior to when said image forming means forms a toner image of a subsequent color of the predetermined numbers of colors on said rotatable image bearing means.

4. An apparatus according to claim 1, wherein said urging means is located in the contact position while said image forming means forms on said rotatable image forming means a toner image of a first color among the plurality of colors.

5. An apparatus according to claim 4, wherein said urging means moves to the separate position after said image forming means completes formation on said rotatable image bearing means of a toner image of a first color and prior to when said image forming means starts forming a toner image of a subsequent color to the first color on said rotatable image bearing means.

6. An apparatus according to claim 1, wherein said apparatus is selectively operable in a first mode, in which said image forming means starts to form a toner image on said rotatable image bearing means while said urging means is located in the contact position, and in a second mode, in which said image forming means starts to form a toner image on said rotatable image bearing means after movement of said urging means from the contact position to the non-contact position is complete, and wherein when the first mode is selected, the start timing for image formation is controlled by said control means.

7. An apparatus according to claim 1, wherein said urging means comprises a transfer member which transfers a multi-color toner image formed on said intermediate transfer member to a transfer material.

8. An apparatus according to claim 7, wherein when said urging means is in the contact position, said transfer member urges a transfer material against said intermediate transfer member to transfer the multi-color toner image to the transfer material, and when said urging means is in the non-contact position, said transfer member is separated from said intermediate transfer member after the multi-color toner image is transferred to a transfer material.

9. An apparatus according to claim 8, wherein when toner images are continuously formed on a first transfer material and a second transfer material, said transfer member is located in the contact position during a period between a start timing of transferring the multi-color toner image to the first transfer material from said intermediate transfer member and of the image forming of the first color for the second transfer material on said image bearing means by said image forming means.

10. An apparatus according to claim 9, wherein said transfer member moves to the non-contact position after said image forming means completes formation of a toner image of the first color on said rotatable image bearing means.

11. An apparatus according to claim 8, wherein when multi-color toner images are continuously formed on a first transfer material and a second transfer material, said apparatus is selectively operable in a first mode, in which during transferring of a multi-color toner image from said intermediate transfer member to the first transfer material, formation of a toner image of the first color in the plurality of colors for the second transfer material is started on said rotatable image bearing means by said image forming means, and in a second mode, in which after completion of transferring of the multi-color toner image from said intermediate transfer member to the first transfer material, formation of a toner image of the first color in the plurality of colors for the second transfer material is stated on said rotatable image bearing means by said image forming means.

12. An apparatus according to claim 11, wherein when operating in the first mode, a start timing for image formation is controlled by said control means.

13. An apparatus according to claim 1, wherein said urging means comprises a charging member which charges residual toner left on said intermediate transfer member after transferring of the multi-color toner image from said intermediate transfer member to a transfer material, the residual toner charged by the charging member thereby being electrostatically transferable to said rotatable image bearing means from said intermediate transfer member.

14. An apparatus according to claim 13, wherein the charging member is locatable in a contact position, in which the charging member abuts said intermediate transfer member for charging residual toner, and in a non-contact position, in which the charging member is separated from said intermediate transfer member.

15. An apparatus according to claim 14, further comprising recovering means for recovering residual toner transferred to said rotatable image bearing means from said intermediate transfer member.

16. An apparatus according to claim 1, wherein said image bearing means comprises an image bearing member on which a multi-color toner image is sequentially formed, which in turn is sequentially transferred in layers to said intermediate transfer member from the image bearing member.

17. An apparatus according to claim 16, wherein said image forming means comprises exposing means for exposing the image bearing member charged with electricity to light at an exposing position to form a latent image on the image bearing member.

18. An apparatus according to claim 17, wherein the exposing position of the exposing means is controlled by said control means.

19. An apparatus according to claim 18, wherein said image forming means comprises developing means for developing a latent image with toner.

20. An apparatus according to claim 1, wherein said rotatable image bearing means comprises a plurality of image bearing members on which toner images having a plurality of colors are formed, respectively, and each of said toner images on the plurality of image bearing members is sequentially transferred in layers to said intermediate transfer member.

21. An apparatus according to claim 20, wherein said image forming means comprises exposing means for exposing the image bearing members charged with electricity to light at an exposing position to form latent images on the image bearing members, respectively.

22. An apparatus according to claim 21, wherein the exposing position of the exposing means is controlled by said control means.

23. An apparatus according to claim 20, wherein said image forming means comprises developing means for developing a latent image with toner.

24. An apparatus according to claim 1, further comprising a first unit including said rotatable image bearing means, said first unit being detachable from a body of said apparatus.

25. An apparatus according to claim 24, further comprising a second unit including said intermediate transfer member, said second unit being detachable from the body of said apparatus.

26. An apparatus according to claim 25, wherein when said second unit is attached to the body of said apparatus, said intermediate transfer member is urged against said rotatable image bearing means under predetermined pressure.

27. An apparatus according to claim 26, wherein said intermediate transfer member comprises an elastic layer.

28. An apparatus according to claim 1, further comprising a unit including said intermediate transfer member, said unit being detachable from a body of said apparatus.

29. An apparatus according to any one of claims 1 to 28, wherein an image forming position in the rotation axial direction of said rotatable image bearing means is controlled by said control means.

30. An apparatus according to any one of claims 1 to 28, wherein an image forming position in a direction orthogonal to a rotational direction of said rotatable image bearing means is controlled by said control means.

31. An apparatus according to any one of claims 1 to 28, wherein an image forming position in the direction of the rotation axis of said rotatable image bearing means and in a direction orthogonal to the rotation axis thereof is controlled by said control means.

32. An apparatus according to claim 31, wherein a length of a toner image in a direction orthogonal to the rotational direction of said rotatable image bearing means is controlled by said control means.

33. An apparatus according to any one of claims 1 to 28, wherein a length of a toner image in the orthogonal direction of the rotation axis of said rotatable image bearing means is controlled by said control means.

* * * * *

UNITED STATES PATENT AND TRADEMARK OFFICE

CERTIFICATE OF CORRECTION

PATENT NO. : 6,094,557

DATED : July 25, 2000

INVENTOR(S) : HAYATO SHINOHARA

It is certified that error appears in the above-identified patent and that said Letters Patent is hereby corrected as shown below:

Sheet 2

Figure 2:
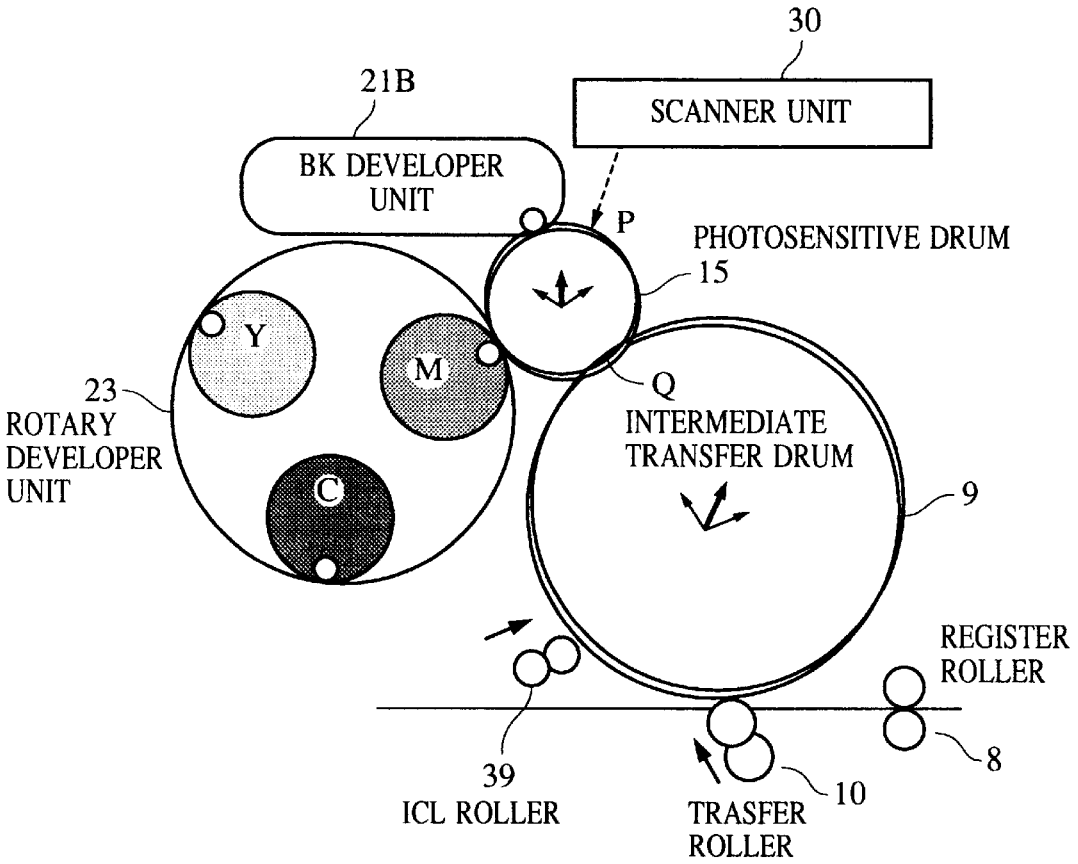
FIG. 2 is a schematic representation of a mechanism in which color mis-registration is produced by a transfer system.
Figure 3:
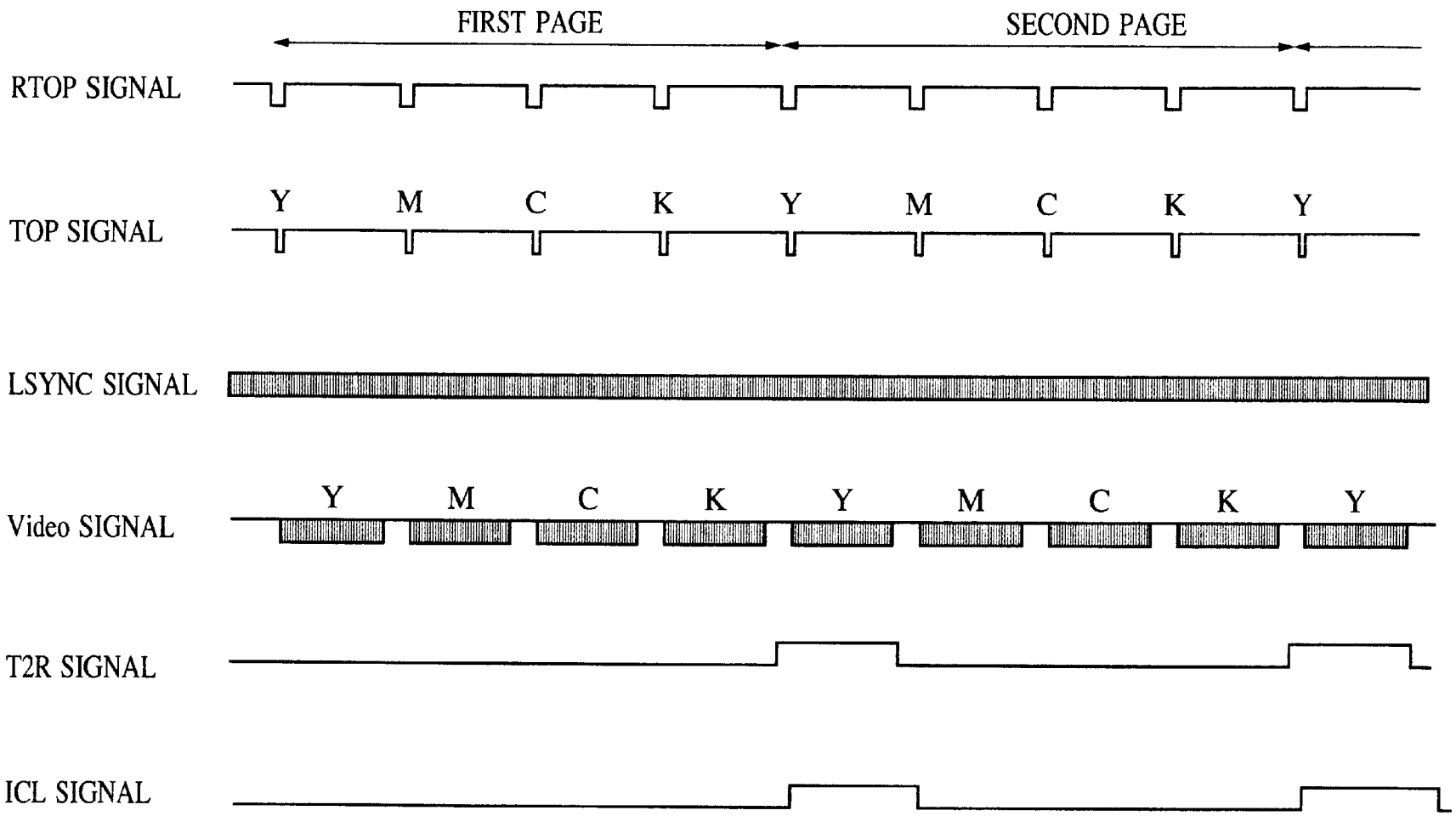
FIG. 3 is a timing chart illustrating color mis-registration caused by the transfer system.
Figure 4:
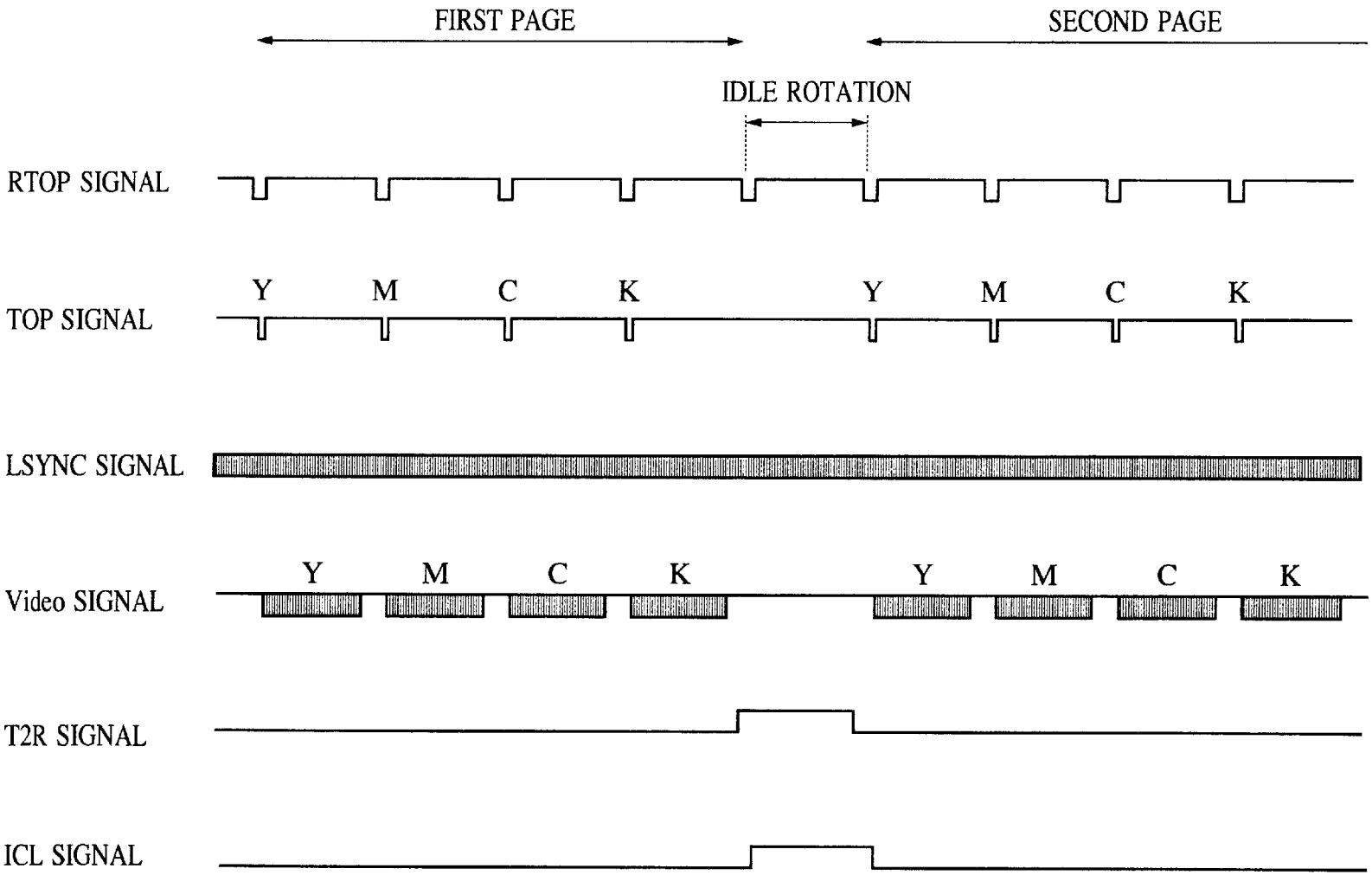
FIG. 4 is a timing chart illustrating a timing for avoiding color mis-registration by means of idle rotation.

Figure 2, "TRASFER ROLLER" should read --TRANSFER ROLLER--.

Sheet 11

Figure 12, "INTERUPTING" should read --INTERRUPTING--.

Column 1

Line 48, "AS" should read --As--.

Column 3

Line 30, "Bearer" should read --Bearing--.
Line 31, "in unison of" should be deleted.
Line 35, "in combination used" should read --used in combination--.
Line 42, "thereon," should read --thereon, and--.

UNITED STATES PATENT AND TRADEMARK OFFICE

CERTIFICATE OF CORRECTION

PATENT NO. : 6,094,557

DATED : July 25, 2000

INVENTOR(S) : HAYATO SHINOHARA

It is certified that error appears in the above-identified patent and that said Letters Patent is hereby corrected as shown below:

Column 4

Line 1, "unison" should read --in unison--.

Column 5

Line 27, "being" should be deleted.
Line 65, "said" should read --solid--.
Line 67, "the" (second occurrence) should be deleted.

Column 7

Line 5, "to the toner)" should read --to that of the toner)--.

Column 8

Line 51, "Δ4," should read --A4,--.

Column 9

Line 20, "SI." should read --S1.--.
Line 29, "the" (second occurrence) should be deleted.

UNITED STATES PATENT AND TRADEMARK OFFICE

CERTIFICATE OF CORRECTION

PATENT NO. : 6,094,557

DATED : July 25, 2000

INVENTOR(S) : HAYATO SHINOHARA

It is certified that error appears in the above-identified patent and that said Letters Patent is hereby corrected as shown below:

Column 9

Line 30, "writing position" should read --the writing position--.

Line 47, "writing" should read --the writing--.

Column 10

Line 64, "teeding" should read --feeding--.

Column 11

Line 36, "members," should read --member.--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*